US006371099B1

(12) United States Patent
Lee

(10) Patent No.: US 6,371,099 B1
(45) Date of Patent: Apr. 16, 2002

(54) PAINT BALL GUN

(76) Inventor: Yi-Hsin Lee, 4F, No. 4, Alley 9, Lane 123, Sec. 3, Jen-Ai Rd., Ta-An Dist., Taipei City (TW)

( * ) Notice: Subject to any disclaimer, the term of this patent is extended or adjusted under 35 U.S.C. 154(b) by 0 days.

(21) Appl. No.: 09/758,571

(22) Filed: Jan. 10, 2001

(51) Int. Cl.[7] ..... F41B 11/00

(52) U.S. Cl. ..... 124/66; 124/58; 124/59; 124/60; 124/61; 124/63; 124/64; 124/65; 124/67; 124/68; 124/69; 124/70

(58) Field of Search ..... 124/60–70

(56) References Cited

U.S. PATENT DOCUMENTS

| | | | | | |
|---|---|---|---|---|---|
| 1,052,123 | A | * | 2/1913 | Bennett | 124/66 |
| 2,580,356 | A | * | 12/1951 | Martin | 124/66 |
| 5,634,456 | A | * | 6/1997 | Perrone | 124/76 |
| 5,775,312 | A | * | 7/1998 | Wilkinson et al. | 124/67 |
| 5,924,413 | A | * | 7/1999 | Johnson et al. | 124/72 |
| 6,250,294 | B1 | * | 6/2001 | Lim | 124/66 |

* cited by examiner

*Primary Examiner*—Charles T. Jordan
*Assistant Examiner*—Stephen A Holzen
(74) *Attorney, Agent, or Firm*—Brinks Hofer Gilson & Lione

(57) ABSTRACT

A paint ball gun includes a gun barrel mounted on a gun handle. The gun barrel is formed with parallel propelling and recuperator chambers for respectively receiving a propelling member and a recuperating unit. A connecting rod interconnects the propelling member and a recuperator member such that the propelling member is movable together with the recuperator member. A manually operable pull unit is mounted in the propelling chamber posteriorly of the propelling member, and includes a pull rod with a front rod portion formed with an elongated slot and a rear rod portion which extends out of the propelling chamber. The connecting rod extends through and is slidable along the elongated slot. The pull unit further has a biasing spring for biasing the pull rod forward. An operating knob provided on the rear rod portion is operable to pull the pull rod rearwardly so as to enable the connecting rod to pull the propelling member rearwardly, thereby resulting in corresponding rearward movement of the recuperator member for engaging a latch member on the gun handle.

3 Claims, 8 Drawing Sheets

PAINT BALL GUN

BACKGROUND OF THE INVENTION

1. Field of the Invention

The present invention relates to a paint ball gun, more particularly to a paint ball gun which prevents injury to the body and the face of the user during operation thereof.

2. Description of the Related Art

Referring to FIGS. 1 to 3, a conventional paint ball gun is shown to include a gun handle 1 and a gun barrel 2 mounted on the gun handle 1. The gun handle 1 has a downwardly extending handgrip portion, and is mounted with a trigger 113 and an upwardly projecting latch member 101 that is operably associated with the trigger 113. The gun barrel 2 is formed with a longitudinally extending propelling chamber 201, a longitudinally extending recuperator chamber 202 parallel to and below the propelling chamber 201, and a longitudinally extending communicating slot 203 to intercommunicate the propelling and recuperator chambers 201, 202. A loading tube 4 is mounted on the gun barrel 2, and is communicated with a front chamber portion of the propelling chamber 201 such that the propelling chamber 201 can be loaded with a paint ball (not shown) via the loading tube 4. The gun barrel 2 is provided with an adapter 8 for communicating a front chamber portion of the recuperator chamber 202 with a high-pressure gas cylinder (not shown). The recuperator chamber 202 has a spring-loaded valve unit 6 disposed in the front chamber portion thereof, and a spring-loaded recuperating unit 7 disposed in a rear chamber portion thereof. The recuperating unit 7 has a recuperator member 902 disposed slidably in the recuperator chamber 202 between the valve unit 6 and a compression spring 703 of the recuperating unit 7. The recuperator member 902 is formed with a latch groove 9022 for engaging the latch member 101, and an engaging hole 9021 for engaging a connecting rod 903 that extends through the communicating slot 203. A propelling member 901 is disposed slidably in the propelling chamber 201, and is connected to the recuperator member 22 by means of the connecting rod 903, which engages an engaging hole 9014 in the propelling member 901. The connecting rod 903 extends transversely between the propelling member 901 and the recuperator member 902, and is slidable along the communicating slot 203 such that the propelling member 901 is movable together with the recuperator member 902 within the gun barrel 2. The propelling member 901 has a rear end provided with an operating knob 9015 which is disposed externally of the propelling chamber 201 and which is operable to pull the propelling member 901 rearwardly so as to move the recuperator member 902 rearwardly for engaging the latch groove 9022 with the latch member 101 and so as to dispose a front end 9011 of the propelling member 901 rearwardly of a lower end of the loading tube 4 to permit loading of a paint ball into the propelling chamber 201 via the loading tube 4. With further reference to FIG. 4, when the trigger 113 is subsequently operated to disengage the latch member 101 from the latch groove 9022, the propelling member 901 and the recuperator member 902 are forced to move forwardly due to biasing action of the spring 703 to propel the paint ball from the front end of the propelling chamber 201. Upon moving forward, the recuperator member 902 pushes a piston rod 603 of the valve unit 6 forwardly to permit the high pressure gas in the cylinder to be introduced into the recuperator chamber 202. The high pressure gas thus forces the recuperator member 902 to move rearwardly so as to once again engage the latch groove 9022 with the latch member 101 in preparation for a subsequent operation. At this time, the propelling member 901 and the operating knob 9015 thereon are moved rearwardly together with the recuperator member 902 to permit loading of a succeeding paint ball. Therefore, the operating knob 9015 is operated only during an initial operation. In the subsequent operations, the recuperator member 902 is pushed rearwardly to engage the latch member 101 by means of the high-pressure gas released from the cylinder, and the propelling member 901 moves rearwardly with the recuperator member 902.

However, since the operating knob 9015 projects from a rear end of the gun barrel 2, and moves fast in the rearward direction due to the high-pressure gas released from the cylinder after each operation, it is very likely that the operating knob 9015 can injure the face or the body of the user during use of the conventional paint ball gun.

SUMMARY OF THE INVENTION

Therefore, the main object of the present invention is to provide a paint ball gun which can solve the aforementioned problem of the prior art.

Accordingly, the paint ball gun of the present invention includes a gun handle, an elongated gun barrel, a propelling member, a recuperating unit, a connecting rod, and a manually operable pull unit. The gun handle has an elongated mounting seat, and a handgrip portion extending downwardly from the mounting seat. The mounting seat is provided with a trigger and a latch member that is operably associated with the trigger and that projects upwardly from the mounting seat. The gun barrel is mounted on the mounting seat, and is formed with a longitudinally extending propelling chamber which has a front chamber portion with an open front end and a rear chamber portion with a rear end that is provided with a rear cap, a longitudinally extending recuperator chamber parallel to the propelling chamber, and a communicating hole which intercommunicates the propelling and recuperator chambers and which extends in a longitudinal direction of the gun barrel. The front chamber portion of the propelling chamber is adapted to be loaded with a paint ball therein. The propelling member is disposed in the propelling chamber, and is movable between the front and rear chamber portions of the propelling chamber. The propelling member has a front section proximate to the front end of the propelling chamber, and an opposite rear section. The recuperating unit has a recuperator member disposed slidably in the recuperator chamber and formed with a latch groove for engaging releasably the latch member, and a first biasing spring for biasing the recuperator member to move forwardly. The connecting rod is disposed slidably in the communicating hole. The connecting rod engages the propelling member and the recuperator member such that the propelling member is movable together with the recuperator member. The pull unit is mounted on the rear chamber portion of the propelling chamber, and includes a pull rod and a second biasing spring. The pull rod has a front rod portion proximate to the rear section of the propelling member and formed with an elongated slot which extends in the longitudinal direction of the propelling chamber, a rear rod portion which extends through the rear cap and which is provided with an operating knob that is disposed outwardly of the propelling chamber, and an annular flange formed between the front and rear rod portions and extending around an axis of the rear rod portion. The connecting rod extends into the elongated slot so as to be slidable therealong. The second biasing spring is sleeved around the rear rod portion of the pull rod, and is disposed between the rear cap and the annular flange of the pull rod for biasing the pull rod to move forwardly relative to the gun barrel. The operating knob is operable to pull the pull rod rearwardly against biasing action of the second biasing spring so as to move the connecting rod with the pull rod and to enable the connecting rod to pull the propelling member rearwardly, thereby resulting in corresponding rearward movement of the recuperator member in the recuperator chamber for engaging the latch groove with the latch member. The trigger is operable to disengage the latch member from the latch groove, thereby permitting forward movement of the recuperator member and the propelling member due to biasing action of the first biasing spring in order to propel the paint ball from the open front end of the propelling chamber.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
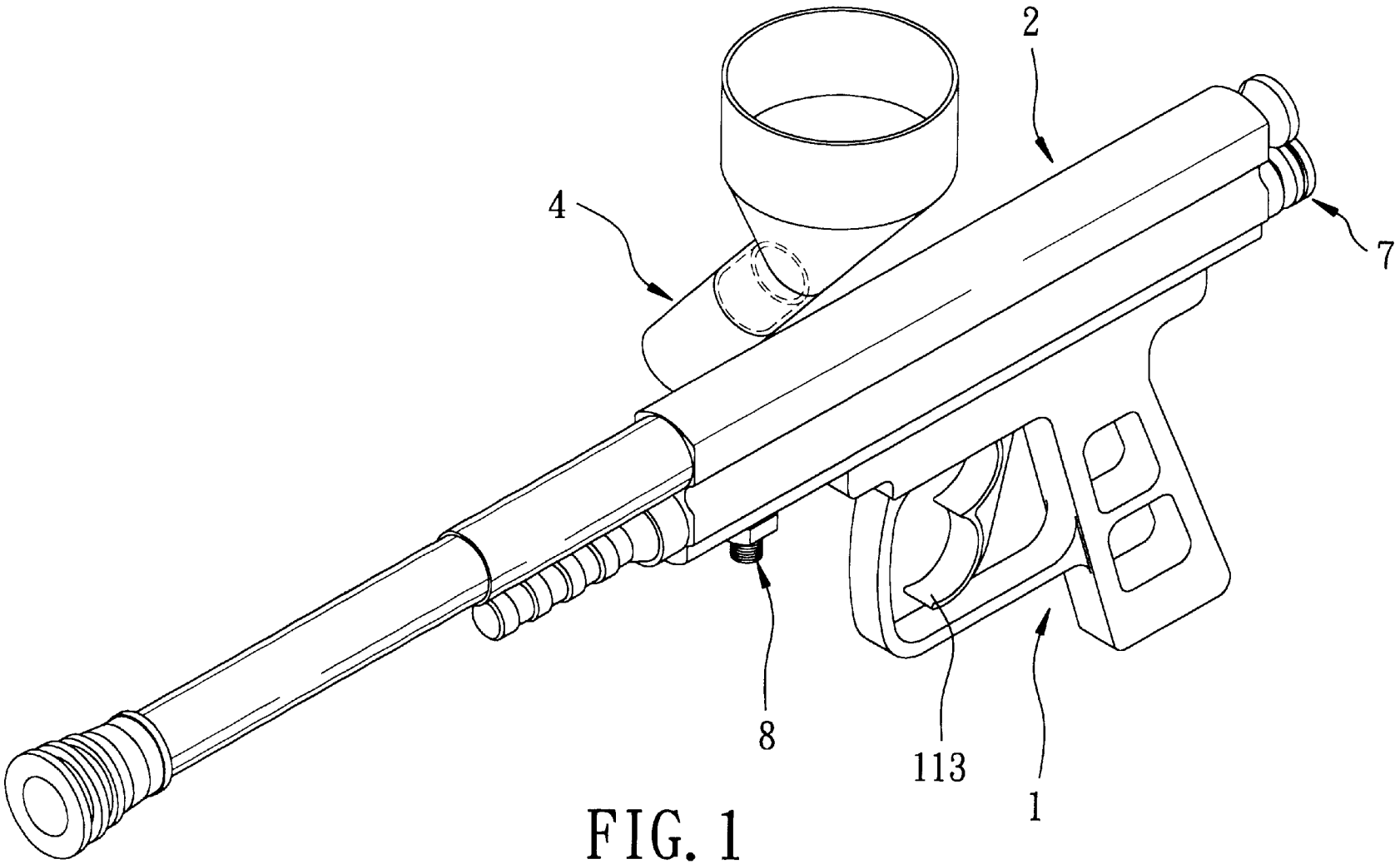
FIG. 1 PRIOR ART
FIG. 1 is a perspective view of a conventional paint ball gun.
Figure 2:
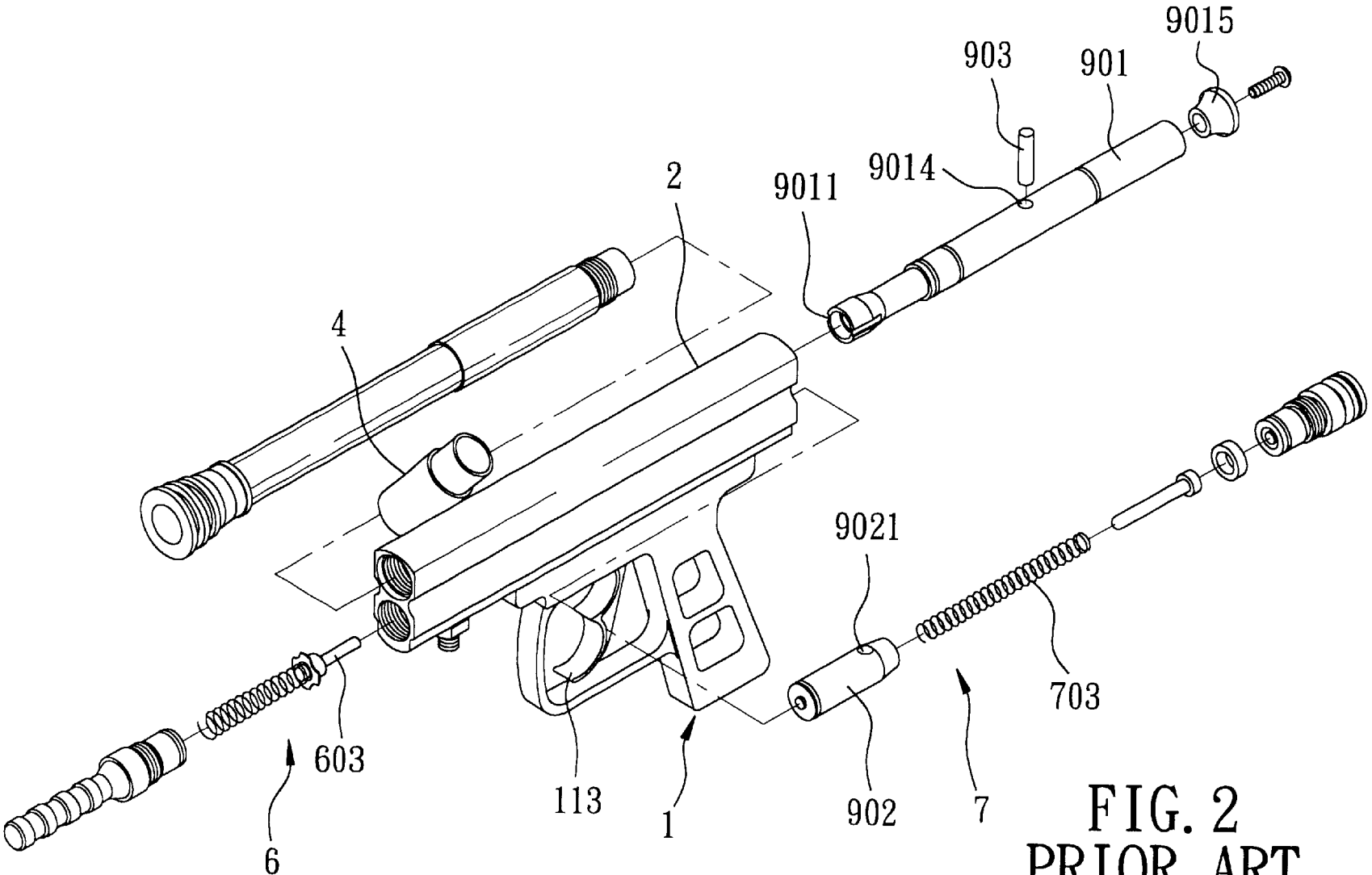
FIG. 2 PRIOR ART
FIG. 2 is an exploded perspective view of the conventional paint ball gun.
Figure 3:
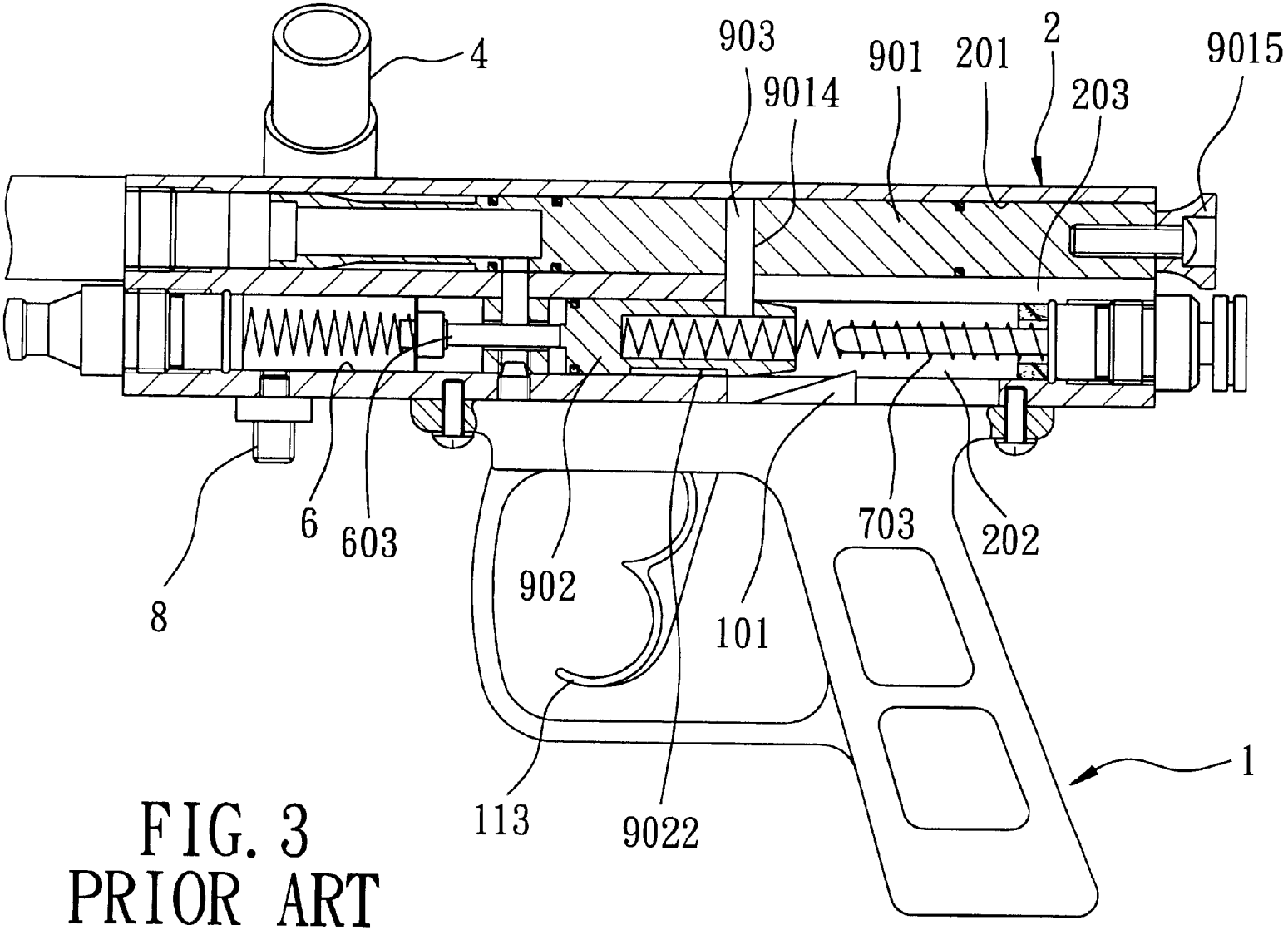
FIG. 3 PRIOR ART
FIG. 3 is a partly sectional view of the conventional paint ball gun.
Figure 4:
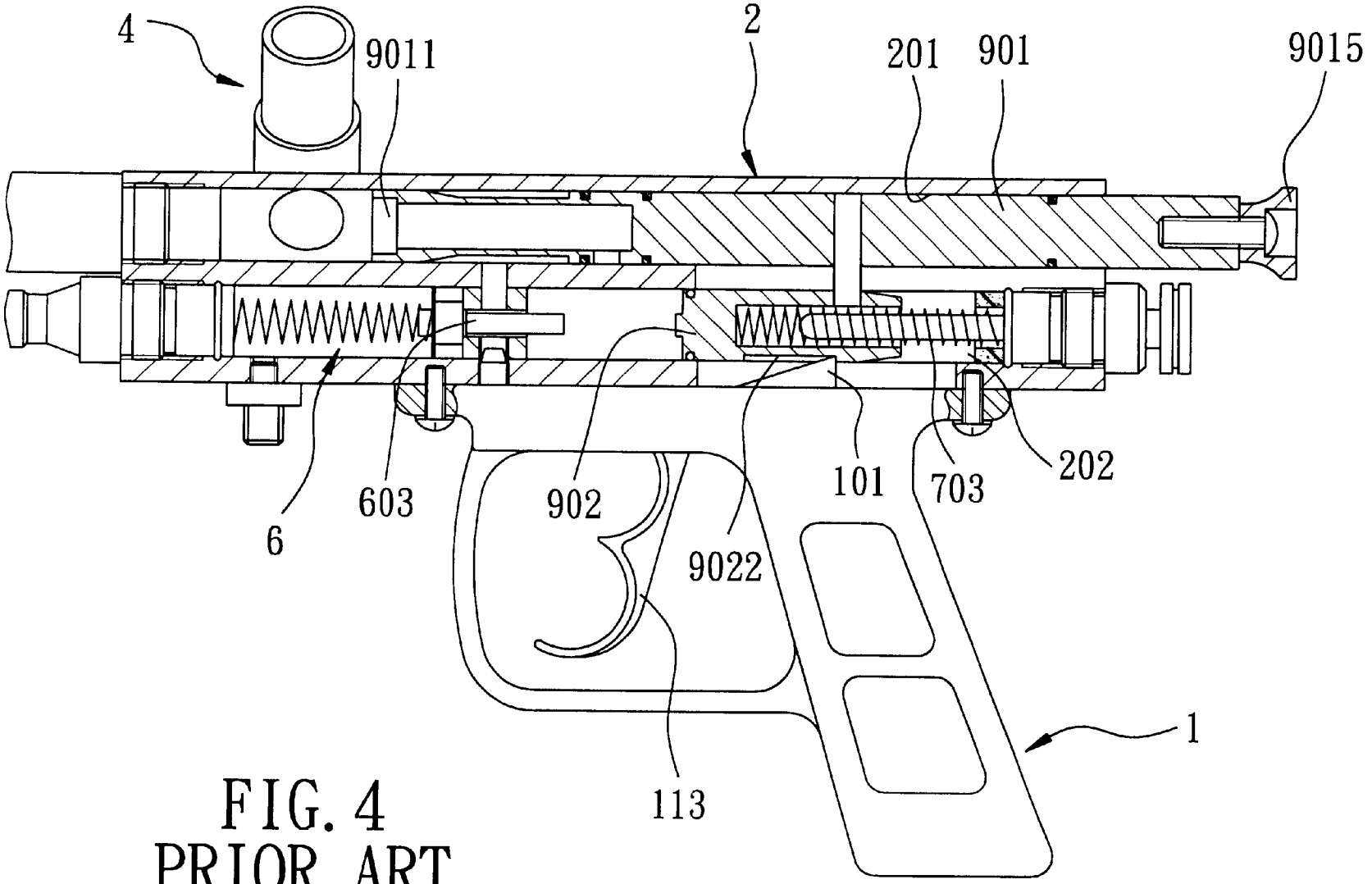
FIG. 4 PRIOR ART
FIG. 4 is another partly sectional view of the conventional paint ball gun when in use, where a propelling member is moved rearwardly to engage a recuperator member with a latch member.
Figure 5:
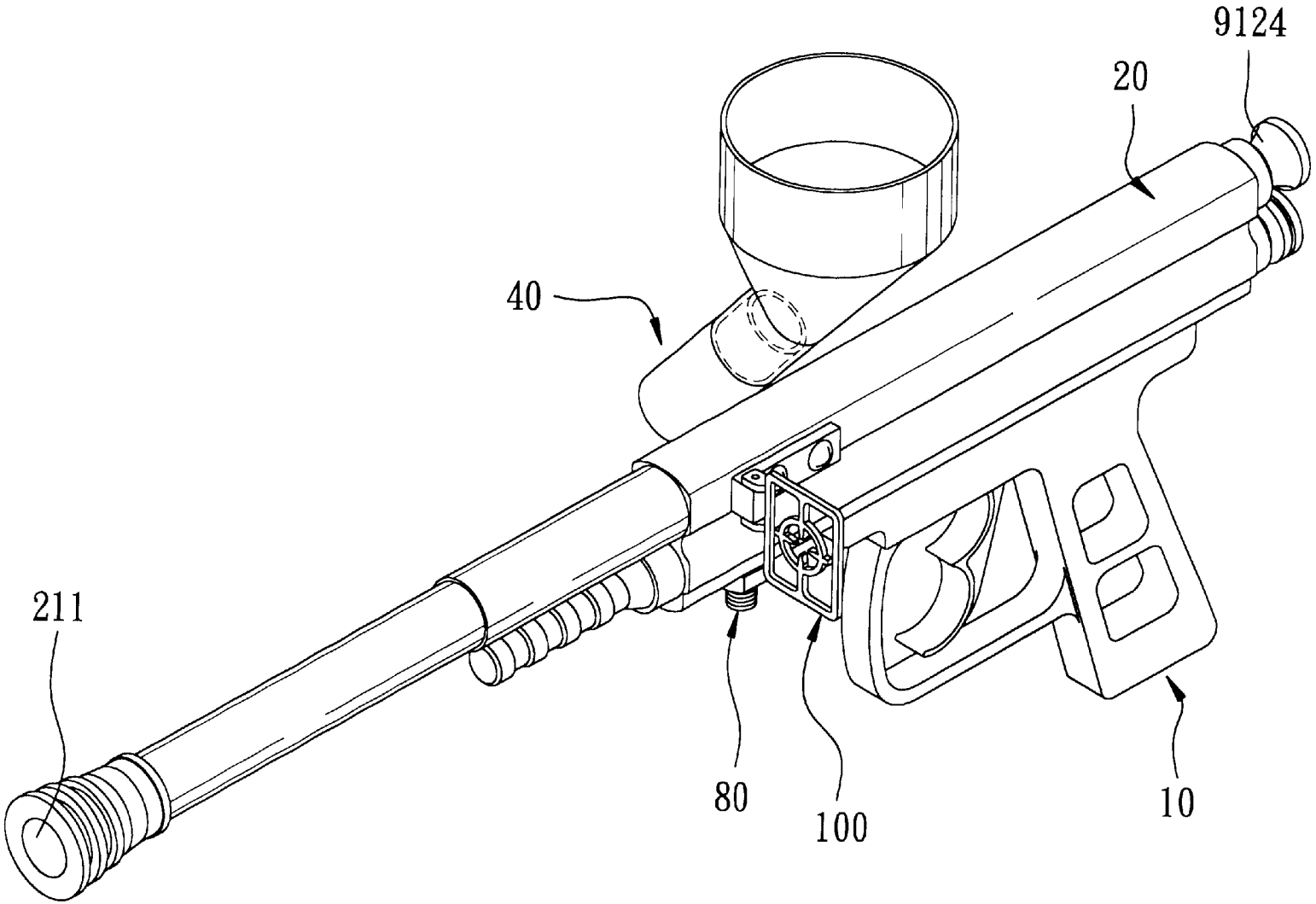
FIG. 5 is a perspective view of a preferred embodiment of the paint ball gun of the present invention.
Figure 6:
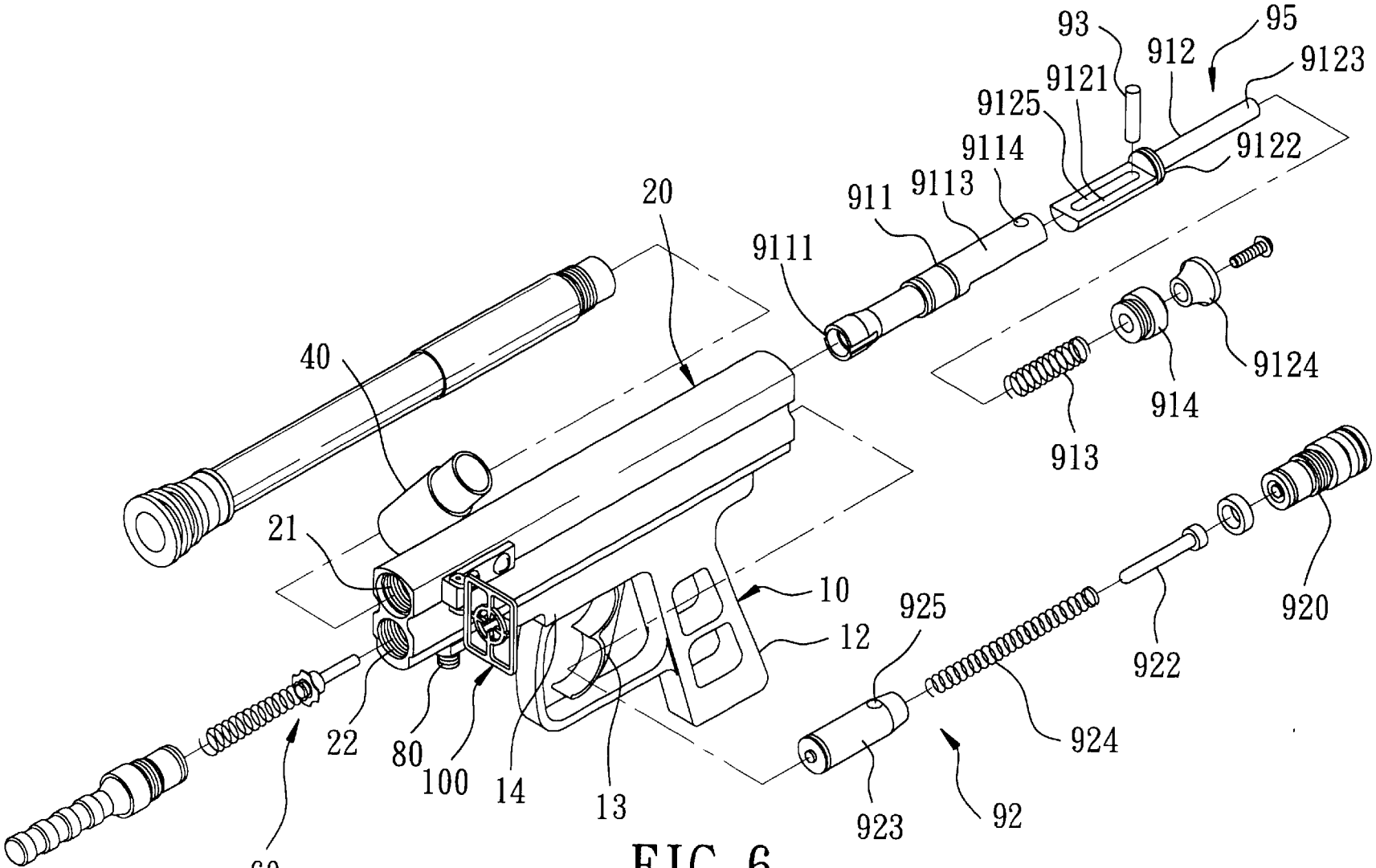
FIG. 6 is an exploded perspective view of the preferred embodiment.
Figure 7:
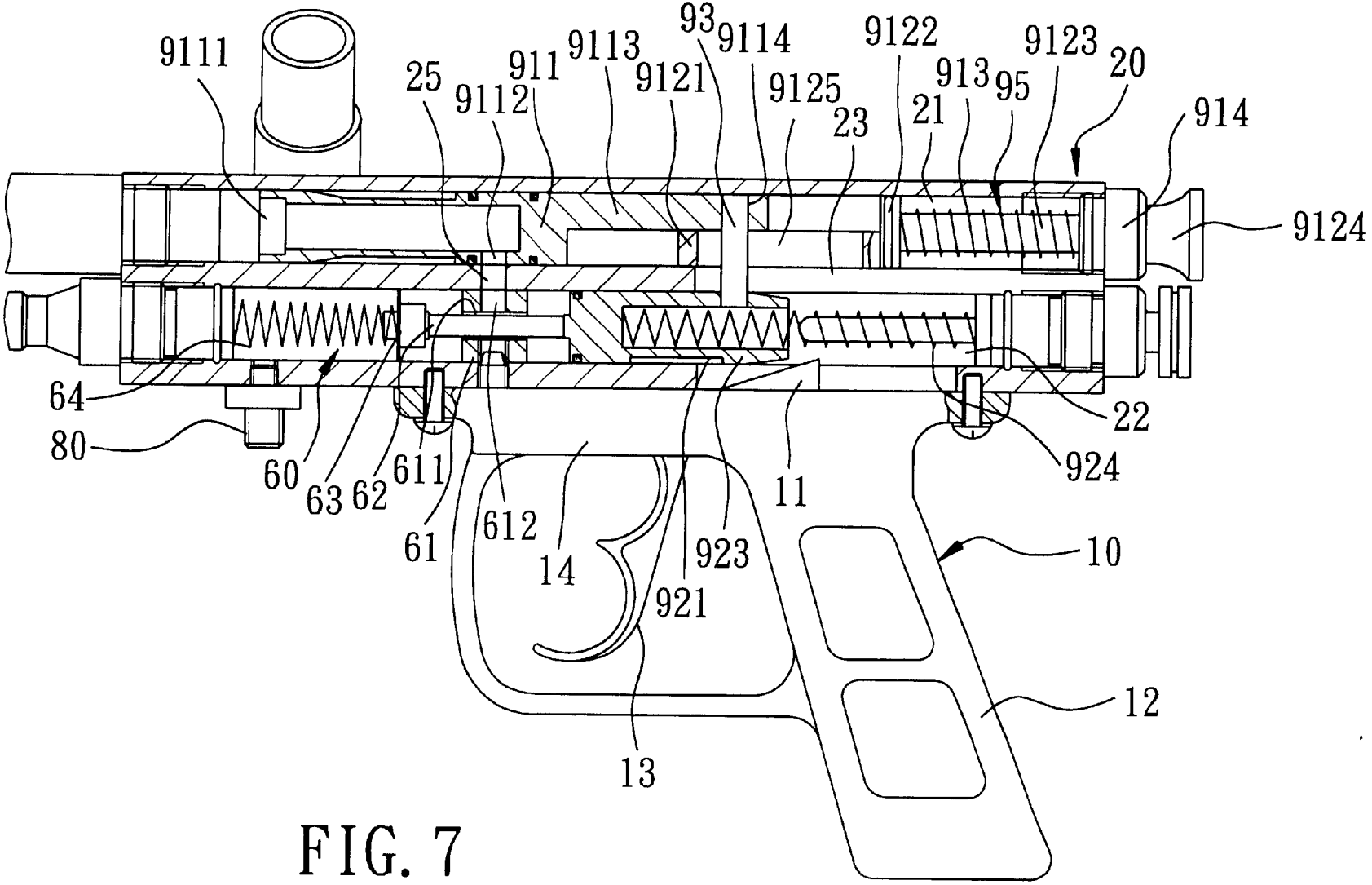
FIG. 7 is a partly sectional view of the preferred embodiment.

Referring to FIGS. 5 to 7, the preferred embodiment of the paint ball gun of the present invention is shown to include a gun handle 10, an elongated gun barrel 20 mounted on the gun handle 10, an elongated propelling member 911, a recuperating unit 92, a manually operable pull unit 95, and a connecting rod 93.

The gun handle 10 has an elongated mounting seat 14, and a handgrip portion 12 extending downwardly from the mounting seat 14. The mounting seat 14 is provided with a trigger 13 and a latch member 11 that is operably associated with the trigger 13 in a known manner and that projects upwardly from the mounting seat 14. The gun barrel 20 is secured on top of the mounting seat 14, and is formed with a longitudinally extending propelling chamber 21, a longitudinally extending recuperator chamber 22 parallel to and formed below the propelling chamber 21, and a longitudinally extending communicating slot 23 to intercommunicate the propelling and recuperator chambers 21, 22. The propelling chamber 21 has a front chamber portion with an open front end 211, and a rear chamber portion with a rear end that is provided with a rear cap 914. A loading tube 40 is mounted on the gun barrel 20 at a lateral side of the same, and has a lower end communicated with the front chamber portion of the propelling chamber 21 such that the propelling chamber 21 can be loaded with a paint ball (not shown) via the loading tube 40. An adapter 80 is mounted on the gun barrel 20 proximate to a front end of the recuperator chamber 22 for coupling with a high-pressure gas cylinder (not shown) to permit introduction of high-pressure gas in the cylinder into the recuperator chamber 22. A valve unit 60 is mounted in the recuperator chamber 22 adjacent to the adapter 80. The valve unit 60 includes a stationary valve seat 61 formed with an axial air passage 611 extending along an axis of the recuperator chamber 22, a piston rod 62 extending axially through the air passage 611, a valve piece 63 secured on one end of the piston rod 62, and a biasing spring 64 for biasing the valve piece 63 to move rearward in the recuperator chamber 22 to close the axial air passage 611. The valve seat 61 is further formed with a radial air passage 612 communicated with the axial air passage 611 and aligned with a through hole 25 formed in the gun barrel 20 between the propelling chamber 21 and the recuperator chamber 22.

The recuperating unit 92 is received in the recuperator chamber 22 posteriorly of the valve unit 60. The recuperating unit 92 includes a plug 920 secured at the rear end of the recuperator chamber 22 for closing the same, a shaft 922 extending forwardly from the plug 920, a recuperator member 923 disposed in front of the shaft 922, and a first biasing spring 924 disposed around the shaft 922 for biasing the recuperator member 923 to move forwardly. The recuperator member 923 has an upper edge formed with an engaging hole 925 and a lower edge formed with a latch groove 921 for engaging releasably the latch member 11.

The propelling member 911 is disposed in the propelling chamber 21, and is movable between the front and rear chamber portions of the propelling chamber 21. The propelling member 911 has a tubular front section with an open front end 9111 proximate to the front end 211 of the propelling chamber 21, and a closed rear end. The propelling member 911 further has a rear section 9113 extending rearwardly from the rear end of the front section. The rear section 9113 has a semi-circular cross-section with a curved top edge and a flat bottom edge, and is formed with an engaging hole 9114 adjacent to a rear end thereof.

The pull unit 95 is mounted on the rear chamber portion of the propelling chamber 21, and includes a pull rod 912, an operating knob 9124 and a second biasing spring 913. The pull rod 912 has a front rod portion 9121 proximate to the rear section 9113 of the propelling member 911, a rear rod portion 9123, and an annular flange 9122 formed between the front and rear rod portions 9121, 9123 and extending around an axis of the rear rod portion 9123. The front rod portion 9121 has a semi-circular cross-section with a curved bottom edge, and is formed with an elongated slot 9125 that extends in the longitudinal direction of the propelling chamber 21. The rear rod portion 9123 has a rear end that extends through the rear cap 914 and that is secured to the operating knob 9124, which is disposed outwardly of the propelling chamber 21. The second biasing spring 913 is in the form of a compression spring, and has a rear end abutting against the rear cap 914 and a front end abutting against the annular flange 9122 for biasing the pull rod 912 to move forwardly in the propelling chamber 21.

The connecting rod 93 extends in a direction transverse to the longitudinal direction of the gun barrel 21, and extends through the communicating hole 23 and the elongated slot 9125 so as to be slidable along the communicating hole 23 and the elongated slot 9125. The connecting rod 93 has an upper end extending into the engaging hole 9114 in the rear section 9113 of the propelling member 911, and a lower end extending into the engaging hole 925 in the recuperator member 923 for interconnecting the propelling member 911 and the recuperator member 923 such that the propelling member 911 is movable together with the recuperator member 923.

Figure 8:
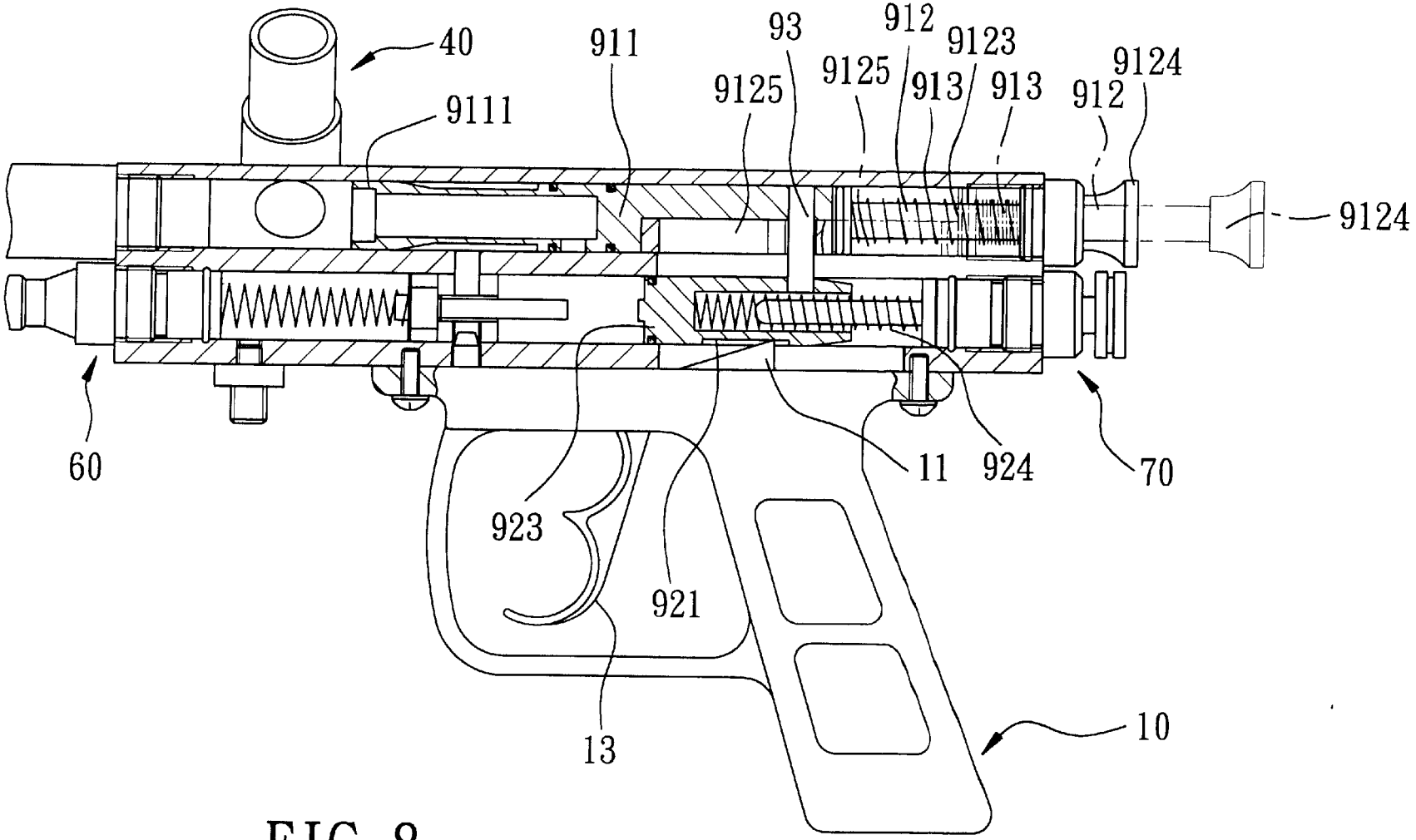
FIG. 8 is a partly sectional view of the preferred embodiment when in use, where a pull unit is operated to move a propelling member and a recuperator member rearwardly and to engage the recuperator member with a latch member.

Referring to FIGS. 7 and 8, before the pull unit 95 is operated, the front rod portion 9121 is disposed below the rear section 9113 of the propelling member 911 due to the biasing action of the biasing spring 913. In use, the operating knob 9124 is pulled manually by the user to pull the pull rod 912 rearwardly against biasing action of the spring 913 and to move the connecting rod 93 with the pull rod 912 so as to enable the connecting rod 93 to pull the propelling member 911 rearwardly. At this time, the front end 9111 of the propelling member 911 is disposed rearwardly of the lower end of the loading tube 40. Simultaneously, the recuperator member 923 is moved rearwardly together with the propelling member 911 to engage the latch groove 921 with the latch member 11. Thereafter, the operating knob 9124 is released to allow the biasing spring 913 to bias the pull rod 912 forward to result in sliding movement of the pull rod 912 relative to the connecting rod 93 and the propelling member 911. After the propelling chamber 21 is loaded with a paint ball (not shown) via the loading tube 40, the trigger 13 can be operated to disengage the latch member 11 from the latch groove 921 so as to force the recuperator member 923 and the propelling member 911 to move forwardly by virtue of the biasing force of the spring 924 for propelling the paint ball from the front end 211 of the propelling chamber 21. When the propelling member 911 is moved to the front chamber portion of the propelling chamber 21 due to the biasing action of the spring 924, a radial air hole 9112 formed in the tubular front section of the propelling member 911 is disposed in alignment with the through hole 25. When the recuperator member 923 is moved forward, the piston rod 62 is pushed forwardly by the recuperator member 923 to move the valve piece 63 away from the valve seat 61 so as to enable the high pressure gas to be introduced through the valve seat 61. Apart of the high pressure gas is introduced through the radial air passage 612, the through hole 25 and the air hole 9112 in the propelling member 911 and into the front chamber portion of the propelling chamber 21 to assist in propelling the paint ball from the propelling chamber 21. Another part of the high pressure gas is introduced through the axial air passage 611 to push the recuperator member 923 rearwardly to once again engage the latch groove 921 with the latch member 11 in preparation for a subsequent operation. At this time, the propelling member 911 moves rearwardly together with the recuperator member 923, and the connecting rod 93 slides within the elongated slot 9125 without causing rearward movement of the pull rod 912 and the operating knob 9124.

Therefore, the operating knob 9124 is pulled rearwardly only during an initial operation. In the subsequent operations, the recuperator member 923 and the propelling member 911 are moved rearwardly by virtue of the high pressure gas released from the cylinder without causing rearward movement of the pull rod 912, thereby obviating reciprocating forward and rearward movements of the operating member 9124 at a rear side of the gun barrel 20.

Referring back to FIG. 5, preferably, a sighting member 100 is mounted on the gun barrel 20 on a lateral side opposite to the loading tube 40 to improve the accuracy when the gun is operated to shoot a target.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A paint ball gun comprising:

a gun handle having an elongated mounting seat, and a handgrip portion extending downwardly from said mounting seat, said mounting seat being provided with a trigger and a latch member that is operably associated with said trigger and that projects upwardly from said mounting seat;

an elongated gun barrel mounted on said mounting seat and formed with a longitudinally extending propelling chamber which has a front chamber portion with an open front end and a rear chamber portion with a rear end that is provided with a rear cap, a longitudinally extending recuperator chamber parallel to said propelling chamber, and a communicating hole which intercommunicates said propelling and recuperator chambers and which extends in a longitudinal direction of said gun barrel, said front chamber portion of said propelling chamber being adapted to be loaded with a paint ball therein;

a propelling member disposed in said propelling chamber and movable between said front and rear chamber portions of said propelling chamber, said propelling member having a front section proximate to said front end of said propelling chamber, and an opposite rear section;

a recuperating unit having a recuperator member disposed slidably in said recuperator chamber and formed with a latch groove for engaging releasably said latch member, and a first biasing spring for biasing said recuperator member to move forwardly;

a connecting rod disposed slidably in said communicating hole, said connecting rod engaging said propelling member and said recuperator member such that said propelling member is movable together with said recuperator member; and a manually operable pull unit mounted on said rear chamber portion of said propelling chamber, said pull unit including a pull rod having a front rod portion proximate to said rear section of said propelling member and formed with an elongated slot which extends in the longitudinal direction of said propelling chamber, a rear rod portion which extends through said rear cap and which is provided with an operating knob that is disposed outwardly of said propelling chamber, and an annular flange formed between said front and rear rod portions and extending around an axis of said rear rod portion, said connecting rod extending into said elongated slot so as to be slidable therealong, and a second biasing spring sleeved around said rear rod portion of said pull rod and disposed between said rear cap and said annular flange of said pull rod for biasing said pull rod to move forwardly relative to said gun barrel;

said operating knob being operable to pull said pull rod rearwardly against biasing action of said second biasing spring so as to move said connecting rod with said pull rod and to enable said connecting rod to pull said propelling member rearwardly, thereby resulting in corresponding rearward movement of said recuperator member in said recuperator chamber for engaging said latch groove with said latch member;

said trigger being operable to disengage said latch member from said latch groove, thereby permitting forward movement of said recuperator member and said propelling member due to biasing action of said first biasing spring in order to propel the paint ball from said open front end of said propelling chamber.

2. The paint ball gun according to claim 1, wherein said front rod portion of said pull rod has a semi-circular cross-section, said rear section of said propelling member being formed with an engaging hole for engaging said connecting rod and having a semi-circular cross-section which complements said front rod portion of said pull rod.

3. The paint ball gun as claimed in claim 1, further comprising a sighting member mounted on said gun barrel.

* * * * *